US008702494B2

(12) United States Patent
Plowman

(10) Patent No.: US 8,702,494 B2
(45) Date of Patent: Apr. 22, 2014

(54) GAMING MACHINE AND METHOD WITH AWARD-ENHANCING SYMBOLS

(75) Inventor: Gregory Leigh Plowman, Alexandria (AU)

(73) Assignee: Aristocrat Technologies Australia Pty Limited (AU)

( * ) Notice: Subject to any disclaimer, the term of this patent is extended or adjusted under 35 U.S.C. 154(b) by 57 days.

(21) Appl. No.: 12/481,758

(22) Filed: Jun. 10, 2009

(65) Prior Publication Data

US 2009/0305769 A1 Dec. 10, 2009

(30) Foreign Application Priority Data

Jun. 10, 2008 (AU) ..... 2008902941

(51) Int. Cl.
*A63F 9/24* (2006.01)
*A63F 13/00* (2006.01)

(52) U.S. Cl.
USPC ..... 463/20; 463/16

(58) Field of Classification Search
USPC ..... 463/16, 20
See application file for complete search history.

(56) References Cited

U.S. PATENT DOCUMENTS

| | | | | |
|---|---|---|---|---|
| 6,089,977 | A * | 7/2000 | Bennett | 463/20 |
| 6,251,013 | B1 * | 6/2001 | Bennett | 463/13 |
| 6,517,432 | B1 * | 2/2003 | Jaffe | 463/16 |
| 2004/0092299 | A1 * | 5/2004 | Gauselmann | 463/16 |
| 2004/0219969 | A1 * | 11/2004 | Casey et al. | 463/20 |
| 2005/0096123 | A1 * | 5/2005 | Cregan et al. | 463/20 |
| 2006/0030397 | A1 * | 2/2006 | Chan | 463/20 |
| 2006/0068883 | A1 * | 3/2006 | Randall et al. | 463/20 |
| 2006/0089191 | A1 * | 4/2006 | Singer et al. | 463/20 |
| 2006/0121974 | A1 * | 6/2006 | Rodgers et al. | 463/16 |
| 2007/0021187 | A1 * | 1/2007 | Gauselmann | 463/20 |
| 2007/0087805 | A1 * | 4/2007 | Taylor | 463/16 |
| 2007/0093287 | A1 * | 4/2007 | Brunelle et al. | 463/19 |
| 2008/0113744 | A1 * | 5/2008 | Whitcher | 463/20 |
| 2008/0153576 | A1 * | 6/2008 | Tempest et al. | 463/20 |
| 2008/0242404 | A1 * | 10/2008 | Aoki | 463/26 |
| 2010/0190543 | A1 * | 7/2010 | Englman et al. | 463/20 |
| 2011/0117987 | A1 * | 5/2011 | Aoki et al. | 463/20 |

FOREIGN PATENT DOCUMENTS

| | | |
|---|---|---|
| AU | 723324 | 8/2000 |
| AU | 2004100259 B4 | 5/2004 |
| AU | 2007202747 B2 | 1/2007 |

* cited by examiner

*Primary Examiner* — Dmitry Suhol
*Assistant Examiner* — Jason Yen
(74) *Attorney, Agent, or Firm* — McAndrews, Held & Malloy, Ltd.

(57) ABSTRACT

A gaming machine comprising a game controller that enhances a prize won from a game outcome when a first special symbol occurs in the game outcome. The appearance of the first special symbol in the game outcome causes the game controller to further enhance the game prize if a second special symbol also appears in the game outcome. The first or second special symbols may further be used to substitute for another symbol in the game outcome, so as to create a winning game outcome.

11 Claims, 6 Drawing Sheets

600

| | | | | |
|---|---|---|---|---|
| A | K | Q | J | Vampire |
| 10 | 10 | 10 | 9 | 8 |
| 7 | 8 | K | Q | A |

602

Figure 6

700

| | | | | |
|---|---|---|---|---|
| K | K | K | K | 7 |
| Q | J | 10 | 9 | 8 |
| 10 | Vampire | 9 | Bat | A |

702 704

Figure 7

GAMING MACHINE AND METHOD WITH AWARD-ENHANCING SYMBOLS

RELATED APPLICATIONS

This application claims priority to Australian Provisional Patent Application No. 2008902941 having a filing date of Jun. 10, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention generally relates to gaming machines and methods of gaming. A particular embodiment of the present invention relates to the award of prizes on individual or linked gaming machines.

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety, while still developing games that comply with the relevant regulations in the jurisdiction of the gaming venue operator. Suppliers of gaming devices therefore are faced with restrictions on the types of games and gaming machines that are allowable, both in terms of the prevailing regulations and in terms of providing a return on investment to the gaming venue operators.

BRIEF SUMMARY OF THE INVENTION

According to a first aspect, the invention broadly resides in a method for use with a gaming machine that is arranged to select symbols, present the selected symbols on a display, and award a game prize if a winning outcome occurs, the method comprising:

monitoring game play activity on the gaming machine for occurrence of a first special symbol;

enhancing the game prize if the first special symbol occurs; and further enhancing the game prize if a second special symbol occurs while the first special symbol occurs in the outcome.

According to a second aspect, the invention broadly resides in a gaming system comprising an game controller and a data storage device comprising game data, the game controller and the data storage device being arranged such that the game controller can process the game data to effect play of a game comprising:

providing a gaming session in which a plurality of symbols are selected and presented on a display, a game prize being awarded if a winning outcome occurs;

monitoring a game outcome for an occurrence of a first special symbol, wherein if the game outcome results in a game prize, the game controller enhances the game prize dependent on the occurrence of the first special symbol;

further monitoring the game outcome for an occurrence of a second special symbol, wherein if the second special symbol occurs in the game outcome while in conjunction with the first special symbol, the game controller further enhances the game prize.

According to a third aspect, the invention broadly resides in instructions executable by a game controller to implement the method as described in the immediately preceding paragraphs and to such instructions when stored in a storage medium readable by the game controller.

According to a further aspect, the invention broadly resides in a data signal carrying instructions and/or data executable to implement the method as described above.

Further aspects of the present invention will be apparent from the following description, given by way of example and with reference to the accompanying drawings. Also, various embodiments of the aspects described in the preceding paragraphs will be apparent from the appended claims, the following description and/or the accompanying drawings.

BRIEF DESCRIPTION OF SEVERAL VIEWS OF THE DRAWINGS

FIG. 6: shows schematically, a first example of a game provided in accordance with an embodiment of the present invention.

FIG. 7: shows schematically, a second example of a game provided in accordance with an embodiment of the present invention.

DETAILED DESCRIPTION OF THE INVENTION

It will be understood that the invention disclosed and defined in this specification extends to all alternative combinations of two or more of the individual features mentioned or evident from the text or drawings. All of these different combinations constitute various alternative aspects of the invention.

Figure 1:
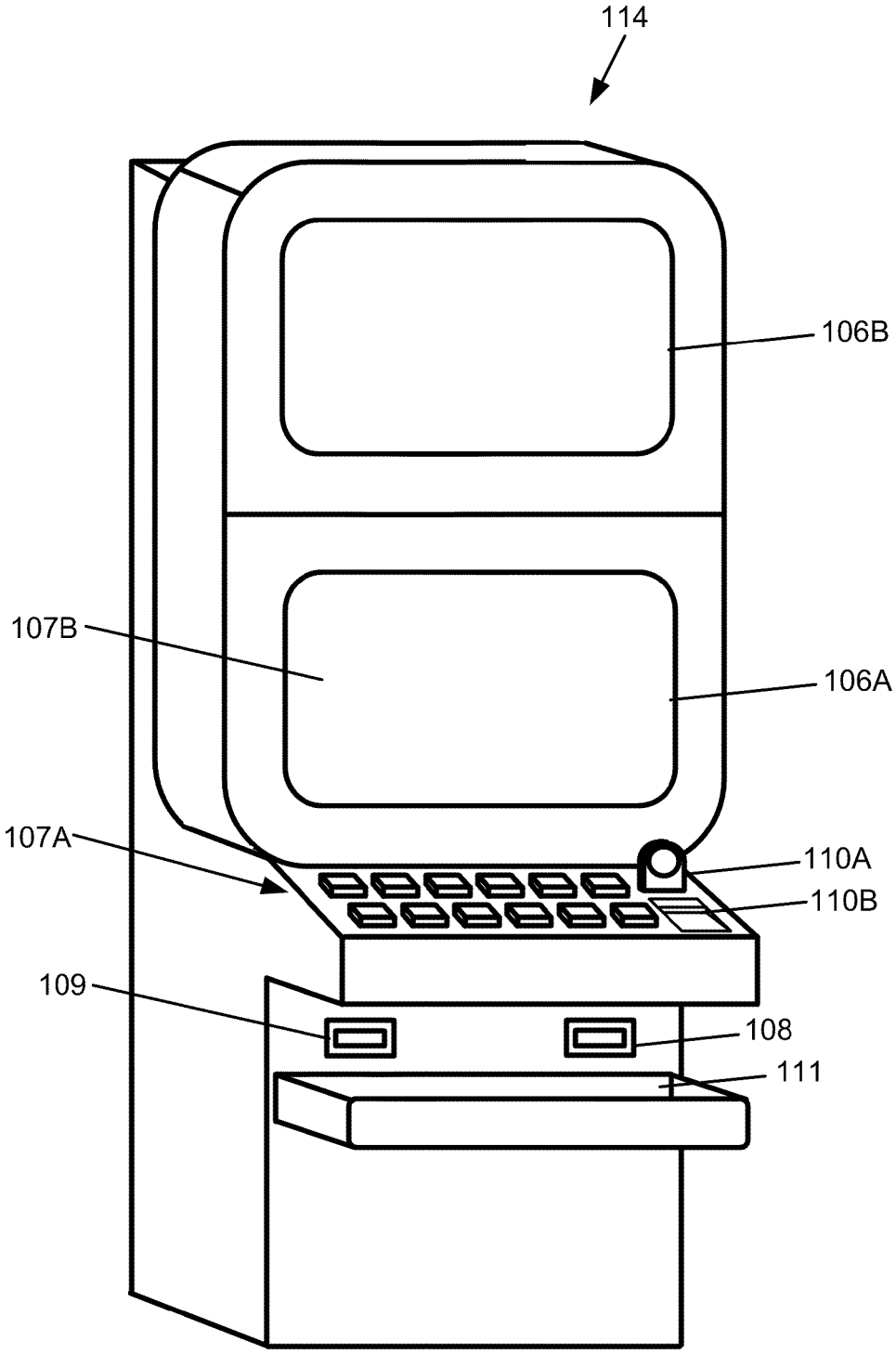
FIG. 1: shows schematically, a view of a gaming console suitable for implementing the present invention.

In FIG. 1 of the accompanying drawings, one example of a gaming console that is suitable to implement the present invention is generally referenced by arrow 114.

The gaming console 114 includes two displays 106A, 106B on one or both of which is displayed representations of a game that can be played by a player and a user input device, including a bank of buttons 107A and/or a touch screen 107B, to enable a player to play the game. The displays 106 may be video display units, such as a cathode ray tube screen device, a liquid crystal display, plasma screen, any other suitable video display unit, or the visible portion of an electromechanical device. The display 106B may display artwork, including for example, pay tables and details of bonus awards and other information or images relating to the game. In alternative gaming consoles the display 106B may be omitted, optionally replaced by a static display.

A credit input including a coin input 110A and/or bill collector 110B allows a player to provide credit for wagering and a coin output 111 is provided for cash payouts from the gaming console 114. A card and/or ticket reader 108 and a printer 109 may be provided to provide player tracking, cashless game play or other gaming and non-gaming related functions.

Figure 2:
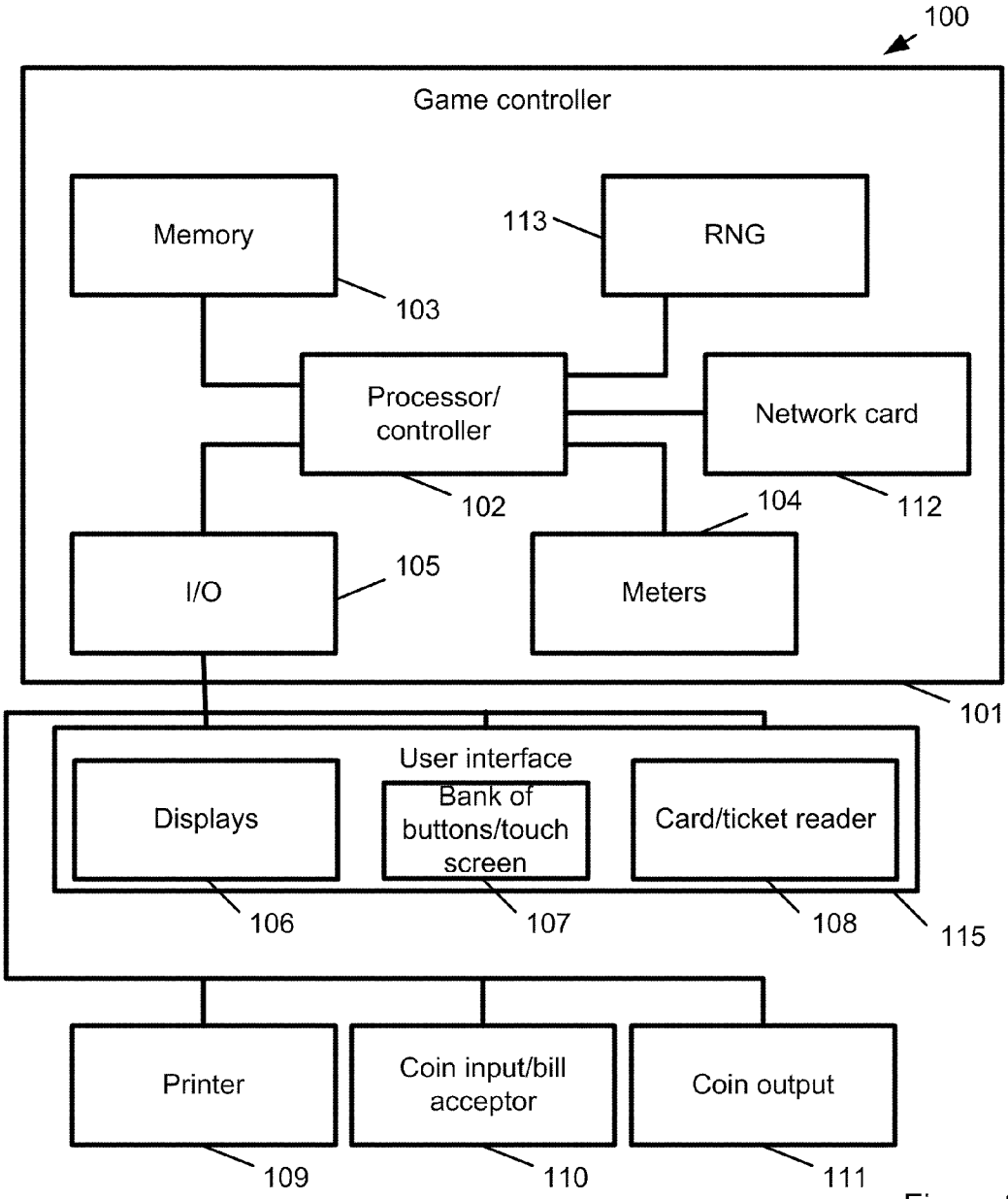
FIG. 2: shows a block diagram of gaming machine suitable for implementing the present invention.

FIG. 2 shows a block diagram of a gaming machine (i.e. gaming console), generally referenced by arrow 100, suitable for implementing the present invention. The gaming machine 100 may include the gaming console 114 shown in FIG. 1 and accordingly like reference numerals have been used to describe like components in FIGS. 1 and 2.

The gaming machine 100 includes a game controller 101, which in the illustrated example includes a computational device 102, which may be a microprocessor, microcontroller, programmable logic device or other suitable device. Instructions and data to control operation of the computational device 102 are stored in a memory 103, which is in data communication with, or forms part of, the computational device 102. Typically, the gaming machine 100 will include both volatile and non-volatile memory and more than one of each type of memory, with such memories being collectively represented by the memory 103. The instructions to cause the game controller 101 to implement the present invention will be stored in the memory 103. The instructions and data for controlling operation of the computational device 102 may be stored on a computer readable medium from which they are loaded into the gaming machine memory 103. The instructions and data may be conveyed to the gaming machine by means of a data signal in a transmission channel. Examples of such transmission channels include network connections, the Internet or an intranet and wireless communication channels.

The game controller 101 may include hardware credit meters 104 for the purposes of regulatory compliance and also include an input/output (I/O) interface 105 for communicating with the peripheral devices of the gaming machine 100. The input/output interface 105 and/or the peripheral devices may be intelligent devices with their own memory for instructions and data.

In the example shown in FIG. 2, the peripheral devices that communicate with the controller are the displays 106, bank of buttons/touch screen 107, the card and/or ticket reader 108, the printer 109, a bill acceptor and/or coin input 110 and a coin output 111. Additional devices may be included as part of the gaming machine 100, or devices omitted as required for the specific implementation.

The bank of buttons 107A and/or touch screen 107B together with one or both of the displays 106 may provide a user interface 115 through which the gaming machine 100 and player communicate. If a card/ticket reader 108 is provided, this may also form part of the user interface 115.

In addition, the gaming machine 100 may include a communications interface, for example a network card 112. The network card 112, may for example, send status information, accounting information or other information to a central controller, server or database and receive data or commands from the central controller, server or database. The network card 112 may also enable communication with a central player account, allowing cashless gaming. One or more of the peripheral devices, for example the card/ticket reader 108 may be able to communicate directly with the network card 112. The network card 112 and the I/O interface 105 may be suitably implemented as a single machine communications interface.

The game controller 101 may also include a random number generator 113, which generates a series of random numbers that are used by the computational device 102 to determine the outcomes of games played on the gaming machine 100.

The game controller 101 may have distributed hardware and software components that communicate with each other directly or through a network or other communication channel. The game controller 101 may also be located in part or in its entirety remote from the user interface 115. Also, the computational device 102 may comprise a plurality of devices, which may be local or remote from each other. Instructions and data for controlling the operation of the user interface 115 may be conveyed to the user interface 115 by means of a data signal in a transmission channel. The user interface 115 may be a computational device, for example a personal computer, used by a person to play a game provided from a remote game controller 101.

Figure 3:
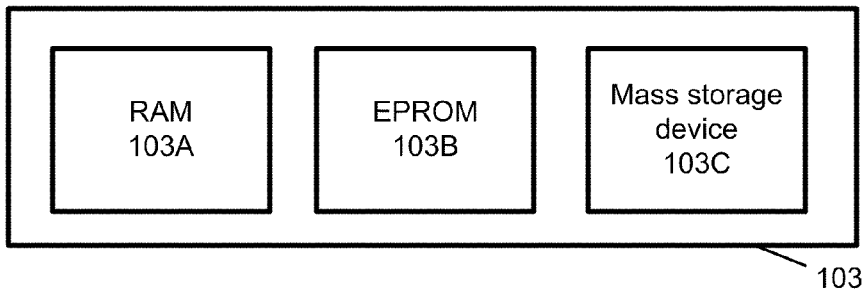
FIG. 3: shows a block diagram of components of the memory of the gaming machine represented in FIG. 2.

FIG. 3 shows an exemplary block diagram of the main components of the memory 103. The RAM 103A typically temporarily holds instructions and data related to the execution of game programs and communication functions performed by the computational controller 102. The EPROM 103B may be a boot ROM device and/or may contain system and game related code. The mass storage device 103C may be used to store game programs, the integrity of which may be verified and/or authenticated by the computational controller 102 using protected code from the EPROM 103B or elsewhere.

Figure 4:
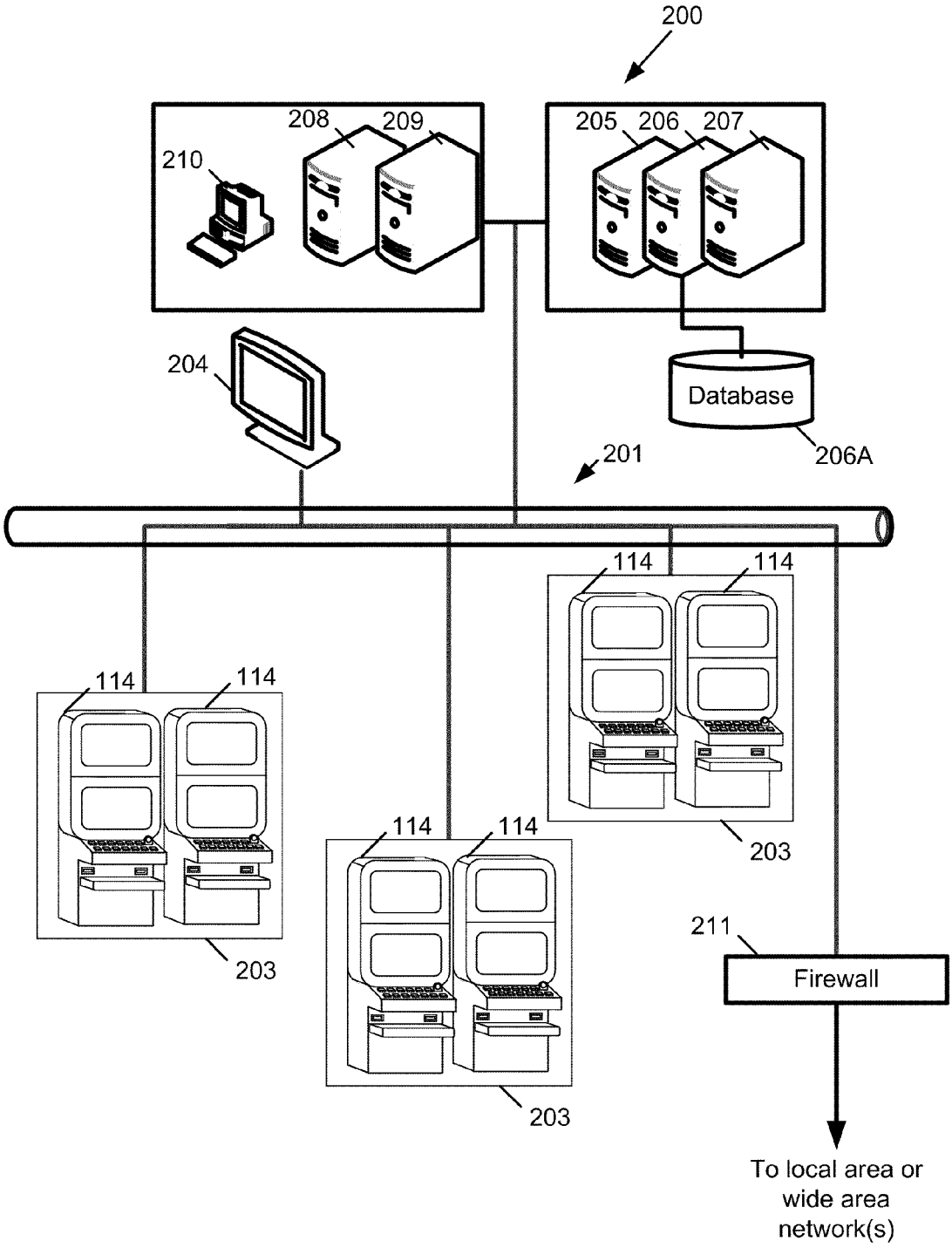
FIG. 4: shows schematically, a network gaming system suitable for implementing the present invention.

FIG. 4 shows a gaming system 200 in the form of a network of devices. The gaming system 200 includes a network infrastructure 201, which for example may be in the form of an Ethernet network. Alternatively, a wireless network and/or direct communication channels, or a different type of network may be used to link the gaming machines to a server, each other and/or other devices. Gaming consoles 114, shown arranged in three banks 203 of two gaming consoles 114 in FIG. 4, are connected to the network infrastructure 201. The gaming consoles 114 may form part or all of a gaming machine 100. Single gaming consoles 114 and banks 203 containing three or more gaming devices 114 may also be connected to the network infrastructure 201, which may also include bank controllers, hubs, routers, bridges to other networks and other devices (not shown).

One or more displays 204 may also be connected to the network 201. The displays 204 may, for example, be associated with a bank 203 of gaming consoles 114. The displays 204 may be used to display representations associated with game play on the gaming devices 114, and/or used to display other representations, for example promotional or informational material.

Servers may also be connected to the network 201. For example, a game server 205 may generate game outcomes for games played on one or more of the gaming consoles 114, a database management server 206 may manage the storage of game programs and associated data in a database 206A so that they are available for downloading to, or access by, game controllers 101, and a jackpot server 207 may control one or more jackpots for the gaming system 200.

Further servers may be provided to assist in the administration of the gaming system 200, including for example a gaming floor management server 208, and a licensing server 209 to monitor the use of licenses to particular games. The servers may include player-tracking functionality, either in a separate player-tracking filter or as software running on one of the other servers 205-209. An administrator terminal 210 is provided to allow an administrator to manage the network 201 and the devices connected to the network. The different servers depicted can be distinct physical servers or logically distinct server processes running on a single physical server.

The gaming system 200 may communicate with other gaming systems, other local networks, for example a corporate network and/or a wide area network such as the Internet through a firewall 211.

Figure 5:
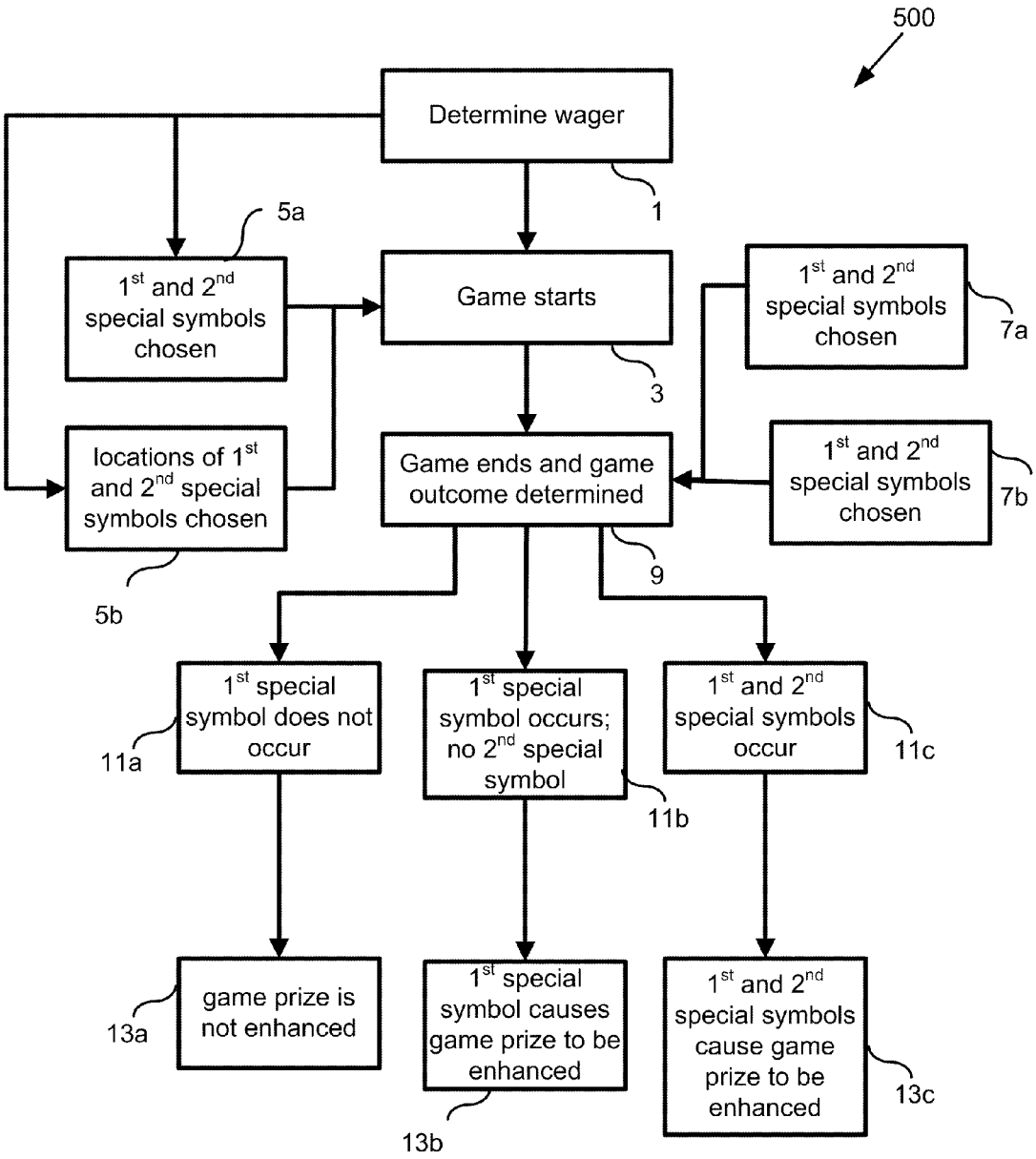
FIG. 5: shows a flow diagram of a process performed in accordance with an embodiment of the present invention.

FIG. 5 shows a process flow diagram of a process 500 performed in accordance with an embodiment of the present invention. The process may be performed by the gaming system 200, in which the gaming consoles 114 each include game controllers 101 to form gaming machines 100 and the following description assumes this implementation. However, those skilled in the relevant arts will appreciate that the process will also be able to be implemented by other gaming systems.

In step 1, the game controller 101 monitors the bill acceptor and/or coin input 110 and/or information received by the card/ticket reader 108 or network card 112 for a deposit of credit and in response causes the hardware meters 104 to increment according to the denomination of the game. The game controller 101 then monitors the user interface 107 for the input of a wager.

If there are sufficient credits in the meters 104 to support the wager, bet, or ante-bet, a game play is commenced in step 3 by the game controller 101. In step 5*a*, the player may be prompted to select a first special symbol and/or a second special symbol. The selection can be made using the user input device (the bank of buttons 107A or the touch screen 107B), before the player commences the game. The player's selection is then communicated to the controller 101. The first and second special symbols, when shown on the display, may have the effect of enhancing some or all of the award, if any, awarded to the player.

Optionally, the player is prompted to choose the location of either or both of the special symbols in step 5*b*. In some embodiments, the special symbols can take effect as long as they appear in lines or reels that are in play. If the location for a special symbol is chosen, then that special symbol must appear at the chosen location in order to enhance the award resulting from a winning outcome. For example, the location chosen is anywhere in the second line. Given a game outcome, only special symbols appearing in the second line take effect in this example.

The special symbols and/or their locations may alternatively be selected by the game controller 101 (in steps 7*a* and 7*b*). This automatic selection can occur in a number of different ways. For example, the selection may be nominated by the game designer and hard-coded into the controller 101. In another example, the controller 101 makes the selection randomly. It is also possible that the game controller 101 makes the selection pursuant to an outcome of a game play.

The selection, once made, may be retained for one game play or a number of game plays. The selection may alternatively be retained until some end condition occurs. For example, the end condition can be the completion of a feature game play, or the completion of a free game play if the gaming machine offers free game plays.

In step 9, the game play occurs and a game outcome is shown on the display 106A. The game controller 101 monitors the game activity and determines an award to be awarded if a winning game outcome occurs. An appearance of a first special symbol in the game outcome may enhance the game prize won pursuant to the winning game outcome. If a second special symbol appears while the first special symbol appears in the display, then the second special symbol also acquires the function of enhancing the game prize. Given this rule, several scenarios are possible with respect to the appearance of the special symbols. It will be understood that an "occurrence" or an "appearance" of the special symbol may refer to a display of the special symbol in a location that is either currently in play or chosen, or both.

In one scenario (step 11*a*), the first special symbol does not appear anywhere (or anywhere in the selected location) in the displayed game outcome. In this case no modification is made to any award awarded to the player if there is a winning outcome (step 13*a*). In a second scenario, one or more first special symbols appear and no second special symbols appear (step 11*b*). Each appearance of the first special symbol may enhance the award (step 13*b*). In a third scenario, one or more first special symbols appear and one or more second special symbols appear (step 11*c*). Each appearance of the first or second special symbol may enhance the award (step 13*c*). It is possible for the first and second special symbols to enhance the game prize differently. For example, an appearance of the first special symbol repeats the original award once, and if a second special symbol appears as well as the first special symbol, the second special symbol repeats the original award twice.

Method 500 of enhancing awards may be applied during normal game play. Alternatively, the method of enhancing the awards may apply during a feature game that is triggered from a base game. There are many ways in which a feature game my be triggered during play of the base game. For example, the feature game may be triggered if a specified outcome occurs in the base game.

Different methods of prize enhancement may be applied. For example, the game rules may define different awards that can be won in a game. In games in which the players can purchase, select or win special prizes, the enhancement may be applied to the special prize. The game controller 101 may enhance the payout on some or all of the game or special prizes, if it detects the presence of a special symbol in the game outcome. An award may be enhanced by, for example, receiving a fixed or percentage bonus, or being repeated once or more than once, or applying a multiplier to the award. The extent to which the award is enhanced may vary depending on whether the game is in base or feature mode. It may also depend on variables such as the bet placed by the player. In some embodiments, the special symbols only act to enhance the award if, for example, the player places at least a minimum bet or an ante bet. The special symbols may only enhance the award if, for example, the player has purchased certain lines or reels.

In some embodiments, the first special symbols may be used as "wilds" that can be used to substitute for any other symbol. A second special symbol may also be used as a wild. In some embodiments, a second special symbol can only be used as a wild if a first special symbol appears. As wilds, the first or second symbols may be used to create a winning game outcome that would not otherwise have occurred. For example, a otherwise non-winning sequence of Q-Vampire-Q would become a winning sequence of Q-Q-Q, because "Vampire" substitutes for "Q".

FIG. 6 to 9 depict examples that demonstrate how the first and second special symbols enhance the awards according to various embodiments of the current technology. The examples refer to a reel spinning game in which 5 reels bearing symbols are spun, simultaneously or in sequence. The spinning reels are animated and rendered to the display 106A. Each reel halts to show 3 symbols in the display window seen on the display 106A, thus presenting a 5×3 array of symbols. The game controller checks to see whether a winning outcome has occurred in the displayed symbol array.

Although the examples are described with references to a reel spinning game, the invention described herein may also be applied to other games such as card games or dice games displayed on the gaming machine. It should further be appreciated that the first and second symbols may enhance the award from a winning outcome of a feature game or a base game.

In each of the example games, the player has purchased three lines (top, centre, and bottom lines). The player bets 1 credit for each line. The "vampire" is nominated as a first special symbol. All prizes in the games are repeated whenever a "vampire" appears anywhere on the display. The "bat" is nominated as the second special symbol. A "bat" repeats the game prizes if it appears along with a "Vampire".

FIG. 6 depicts one exemplary game 600 according to the current technology. The three "10"s appearing on the centre line result in an award of 5 credits. Because "Vampire" 602 appears in the outcome, the award of 5 credits is repeated once. The total award is 10 credits.

FIG. 7 depicts another exemplary game 700 according to the current technology. The four "K"s appearing in the top line result in an award of 25 credits. The "Vampire" 702 in the game outcome repeats this award once. The occurrence of "Vampire" 702 also causes the "Bat" 704 to repeat this award once. Therefore the total award is 75 credits.

Figure 8:
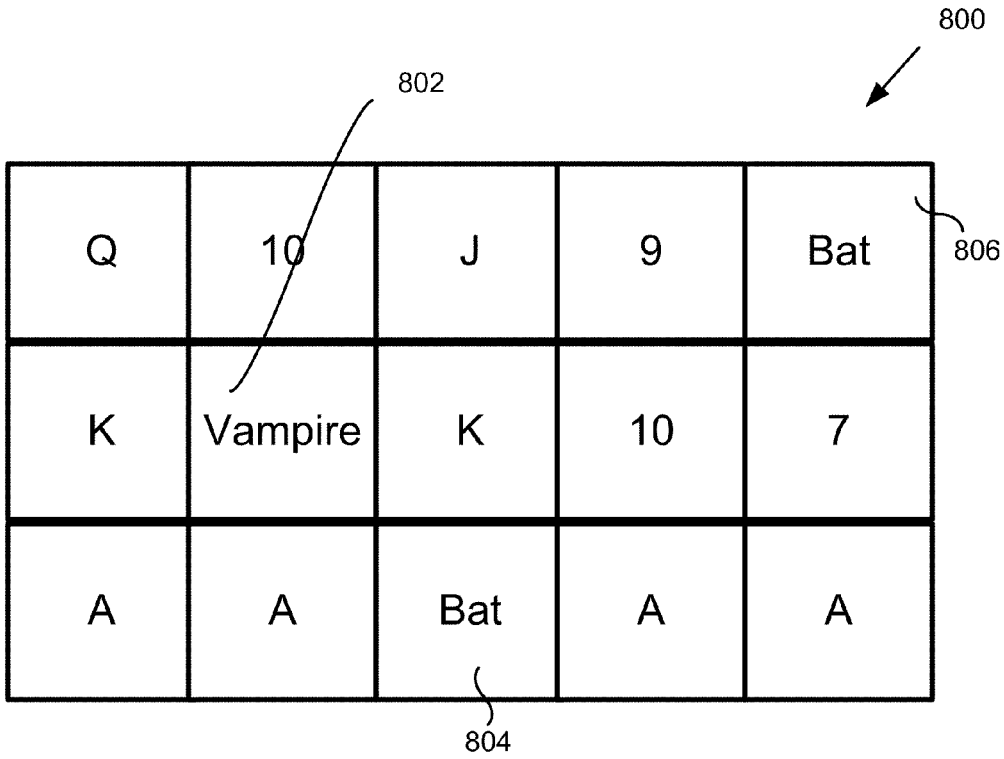
FIG. 8: shows schematically, a third example of a game provided in accordance with an embodiment of the present invention.

FIG. 8 depicts another exemplary game 800 according to the current technology. In this game, the "Vampire" and the "Bat" are both wild. In the centre line, the "Vampire" 802 substitutes for "K". The three "K"s result in an award of 10 credits. In the bottom line, the "Bat" 804 substitutes for "A". The five "A"s result in an award of 100 credits. The total original award is 110 credits. The "Vampire" in the centre line further causes the original award to be repeated once. Because the "Vampire" is in the game outcome, the "Bat" 806 in the top line and the "Bat" 804 in the bottom line each cause the original award to be repeated once. The total award is 440 credits.

Figure 9:
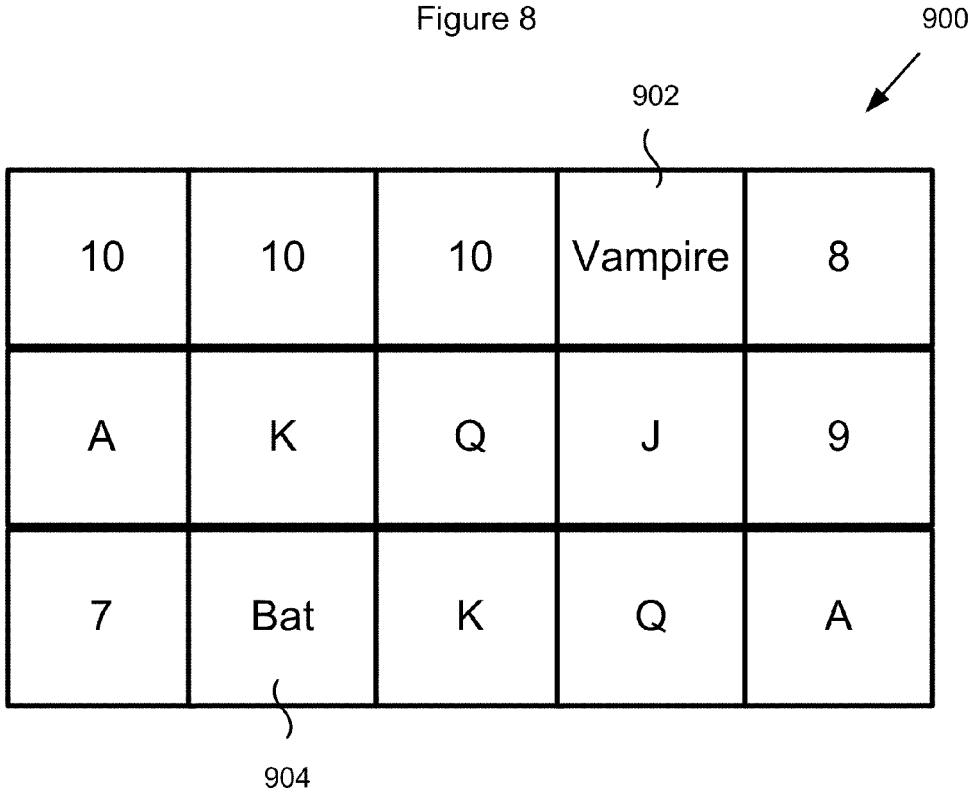
FIG. 9: shows schematically, a fourth example of a game provided in accordance with an embodiment of the present invention.

FIG. 9 depicts a further exemplary game 900 according to the current technology. This game is a feature game, and during a feature game, a special symbol can repeat the award three times. Further, the special symbols can be used as wilds.

In the top line, the game controller 101 uses the "Vampire" 902 as a wild to substitute for a "10". The four "10"s then result in an award of 20 credits. The controller awards three repeats of this award because of the "Vampire" 902. The controller also awards another three repeats of the award because the "Bat" 904 appears along with the "Vampire." The total award is 140 credits.

It will be appreciated that the embodiments aforementioned may be implemented in a linked game, in which one or more players participate (see FIG. 4). In one example, an external bonus or jackpot controller 207 communicates with all of the gaming machines 114 that are active in the linked game. The communication is carried out over a communications network 201. The bonus/jackpot controller may control the operation of any feature games. In some embodiments the bonus/jackpot controller may be integrated into the game server 205. Alternatively the bonus/jackpot controller may be a distinct standalone 'black box'. During each game, the award won from one (or two, or more) active machine may be enhanced. This machine will be the first (or second, or subsequent) machine to display the first special symbol in a winning game outcome. In some examples, the second or subsequent machines to display the first special symbols in winning outcomes receive the award enhancement. The first machine to display the symbol may receive the largest enhancement, with the subsequent machines receiving progressively smaller award enhancements.

While the foregoing description has been provided by way of example of the preferred embodiments of the present invention as presently contemplated, which utilise gaming machines of the type found in casinos, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

The invention claimed is:

1. A method for use with a gaming machine having a display and a controller, the display having a plurality of symbol positions, and the controller being configured to select symbols from a plurality of available symbols to form an outcome, present the selected symbols of the outcome in respective ones of the plurality of symbol positions on the display, and award an award if a winning combination is formed from the symbols presented in the plurality of symbols positions on the display, the method comprising:

receiving by the controller a player selection of two symbols from the plurality of available symbols;

receiving by the controller a player selection of at least one of said symbol positions;

designating the two player-selected symbols as a first special symbol and a second special symbol, respectively;

monitoring game play activity on the display via the controller for occurrence of the first special symbol displayed in the at least one player-selected symbol position in the outcome;

enhancing via the controller the award in response to the first special symbol occurring in the outcome in the at least one player-selected symbol position; and further enhancing via the controller the award in response to both the second special symbol and the first special symbol occurring in the outcome.

2. The method of claim 1, wherein enhancing the award comprises repeating the award at least once.

3. The method of claim 2, and wherein a number of times the award is repeated depends on the number of first and second special symbols presented on the display.

4. The method of claim 1, wherein only the award won from a current game is enhanced.

5. The method of claim 1, and wherein the award includes at least one of an award from a base game and an award from a feature game, and wherein the award from the base game and the award from the feature game are enhanced to different extents.

6. The method of claim 1, wherein the award is only enhanced when a bet made exceeds a minimum bet.

7. The method of claim 1, and wherein if a special prize is purchased or selected prior to game play, the award is a special prize that is enhanced in response to the first special symbol occurring in the outcome, and further enhanced in response to both the second special symbol and the first special symbol occurring in the outcome.

8. The method of claim 1, further comprising substituting the first special symbol for one or more of the available symbols to provide a winning outcome.

9. The method of claim 1, and wherein a first special symbol retains a property of being a first special symbol until a specified end condition is reached.

10. The method of claim 1, and wherein a second special symbol retains a property of being a second special symbol until a specified end condition is reached.

11. A gaming system comprising a display having a plurality of symbol positions, a game controller, and a data storage device comprising game data, the game controller being configured to process the game data to effect play of a game;

receive from a player a selection of two symbols from a plurality of available symbols;

receive from a player a selection of at least one of said symbol positions;

designate the two player-selected symbols as a first special symbol and a second special symbol, respectively;

provide a gaming session in which 1) a plurality of symbols are selected from the plurality of available symbols to form an outcome and 2) the outcome is presented at the plurality of symbol positions on the display;

award a game prize if the displayed outcome includes a winning combination;

monitor the game session for an occurrence of the first special symbol displayed in the at least one player-selected symbol position in the outcome;

enhance the game prize in response to the first special symbol occurring in the outcome in the at least one player-selected symbol position, if the game outcome results in a game prize;

further monitor the game session for the second special symbol occurring in the outcome; and further enhance the game prize, in response to both the second special symbol and the first special symbol occurring in the outcome.

* * * * *

UNITED STATES PATENT AND TRADEMARK OFFICE

CERTIFICATE OF CORRECTION

PATENT NO. : 8,702,494 B2
APPLICATION NO. : 12/481758
DATED : April 22, 2014
INVENTOR(S) : Plowman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 202 days.

Signed and Sealed this
Twenty-first Day of July, 2015

Michelle K. Lee

Michelle K. Lee
*Director of the United States Patent and Trademark Office*